US007660540B2

(12) United States Patent
Tanaka et al.

(10) Patent No.: US 7,660,540 B2
(45) Date of Patent: Feb. 9, 2010

(54) IMAGE FORMING APPARATUS AND IMAGE FORMING METHOD

(75) Inventors: Hiroshi Tanaka, Matsumoto (JP); Yoichi Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 334 days.

(21) Appl. No.: 11/925,444

(22) Filed: Oct. 26, 2007

(65) Prior Publication Data

US 2008/0107441 A1 May 8, 2008

(30) Foreign Application Priority Data

Oct. 27, 2006 (JP) ..... 2006-292415

(51) Int. Cl.
*G03G 15/08* (2006.01)

(52) U.S. Cl. ..... 399/27; 399/83; 399/227

(58) Field of Classification Search ..... 399/9, 399/13, 24–29, 120, 222, 223, 226, 227, 399/228

See application file for complete search history.

(56) References Cited

U.S. PATENT DOCUMENTS

2002/0021906 A1* 2/2002 Yoshizaki et al. ..... 399/12
2004/0196488 A1* 10/2004 Tanaka et al. ..... 358/1.14
2006/0034626 A1* 2/2006 Tanaka ..... 399/12

FOREIGN PATENT DOCUMENTS

WO WO 03/098356 11/2003

* cited by examiner

*Primary Examiner*—David P Porta
*Assistant Examiner*—Benjamin Schmitt
(74) *Attorney, Agent, or Firm*—Hogan & Hartson LLP

(57) ABSTRACT

An image forming apparatus includes a development portion holder mounted with a plurality of development portions having a memory storing plural types of information on the corresponding development portion and that selectively portions one of the development portions in a predetermined development positions by holding and moving the mounted development portions; a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position.

11 Claims, 11 Drawing Sheets

HOME POSITION

IMAGE FORMATION POSITION

DETACHMENT POSITION

FIG. 5

| BANK NO. | INFORMATION TYPE | DETAILS OF INFORMATION | ACCESS TYPE |
|---|---|---|---|
| 1 | IDENTIFICATION INFORMATION OF DEVELOPMENT UNIT | TONER COLOR MANUFACTURE LOT NO. | R |
| 2 | INFORMATION FOR LIFETIME MANAGEMENT | RESIDUAL QUANTITY OF TONER OPERATION TIME OF DEVELOPMENT ROLLER | R/W |
| 3 | INFORMATION EXCEPT FOR LIFETIME MANAGEMENT | NUMBER OF ATTACHMENT AND DETACHMENT BIAS SETTING VALUE | R/W |
| 4 | INFORMATION ON MAIN BODY | NUMBER OF IMAGES TOTAL OPERATION TIME | R/W |

IMAGE FORMING APPARATUS AND IMAGE FORMING METHOD

BACKGROUND

1. Technical Field

The present invention relates to an image forming apparatus and an image forming method forming an image while switching a plurality of development portions and also writing information on the development portions to a memory disposed in the corresponding development portion.

2. Related Art

In an image forming apparatus in which a development port holder is mounted with a plurality of development portions and which forms an image while switching the development portions, the respective development portions can include a memory for storing lifetime information of the respective development portions. For example, in the image forming apparatus disclosed in WO03/098356 (for example, FIG. 9A), the plurality of development portions are mounted in a rotary and rotated so that one of the development portions which is positioned at a position opposite a photosensitive member develops an electrostatic latent image. The respective development portions are provided with a memory cell for storing information on the respective development portions and with a wireless communication antenna. When one of the development portions is positioned at the position opposite the photosensitive member, the antenna is disposed so as to communicate with another antenna mounted in another development portion. In addition, while one of the development portions develops the electrostatic latent image, the antenna of the one of the development portions communicates with the antennas of the other development portions which do not develop in order to read and write the information.

The inventors have found that, in an apparatus which forms an image while moving and switching development portions, it is desirable to set time longer until the development portion starts to perform a developing process after the respective development portions are switched in order to improve an image quality. It is considered that the reason for setting the time longer is because some time is necessary to stably show characteristic.

Accordingly, when the respective development portions are switched, it is necessary to immediately switch the development portion which finishes the developing process to the next development portion. However, when the respective development portions are switched so quickly in this way, a known image forming apparatus may not appropriately write information on the respective development portions. That is because the respective development portions stay for a short time, but it is necessary to take some processing time for writing information on the development portion. In contrast, when the respective development portions are not switched until all information is completely written, the development portion may not be switched quickly.

SUMMARY

An advantage of some aspects of the invention is that it provides a technique for appropriately writing information on respective development portions while quickly switching the development portions.

According to an aspect of the invention, there is provided an image forming apparatus including: a development portion holder that is mounted with a plurality of development portions having a memory storing plural types of information on the corresponding development portion and that selectively portions one of the development portions in a predetermined development positions by holding and moving the mounted development portions; a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority, and the access unit records only some information of the plural types of information in the memory and most frequently records the information with the highest priority in the memory, while the development portions stays at the access position.

According to another aspect of the invention, there is provided an image forming method of selectively positioning a plurality of development portions in a predetermined corresponding development position, forming an image using the development portions positioned at the development position, and accessing a memory of the respective development portions positioned at an access position different from the development position to perform an image forming process of writing plural types of information on the development portion, the image forming method including: predetermining the plural types of information in priority; writing only some information among the plural types of information in the memory while the respective development portions stay at the access position; and writing the information with the highest priority in the memory most frequently.

According to the image forming apparatus with the above-described configuration, the plural types of some information are written on the memory of the respective development portions in one access process. Accordingly, it is not necessary to write all the plural types of information in the one access process. As a result, it is possible to shorten the access time and to quickly switch the development portions. In addition, when some information to be written is omitted in order to shorten writing time, significant information may not be updated at the necessary timing. However, since the information is configured to have priority and the information with the highest priority is written most frequently, it is possible to reliably update the significant information.

For example, the plural types of information may be grouped into Ng groups from a first group with the highest priority to an Ng-th group (where Ng is a natural number of 2 or more) with the lowest priority by the priority, and the access unit may record the information belonging to a single group in the memory while the respective development portions stay at the access position and the group to be recorded is sequentially and circularly changed from the first group whenever the corresponding development portion is positioned at the access position.

For example, an expression "the groups to be written are sequentially and circularly changed from the first group" means as follows. That is, according to the invention, when the respective development portions stay at the access position, a process of writing all the information belonging to one group is performed. However, whenever the respective development portions stay at the access position, the group to be stored is sequentially changed in an order of a first group, a second group, . . . , and the next group, and the last Ng-th group returns to the first group to be stored.

Accordingly, since the information belonging to the first group with the highest priority is recorded in the memory more frequently than the other groups, it is possible to reliably record more significant information while shortening the writing time.

For example, the plural types of information may be grouped into Ng groups from a first group with the highest priority to an Ng-th group (where Ng is a natural number of 3 or more) with the lowest priority by the priority, and the access unit may record the information belonging to two or (Ng-1) groups including the first group in the memory while the respective development portions are positioned at the access position and the group to be recorded other than the first group is sequentially and circularly changed from the second group whenever the respective development portions are positioned at the access position.

In the image forming apparatus with the above configuration, the information belonging to the first group with the highest priority can be recorded whenever the development portions stay at the access position. Moreover, the information belonging to the other groups other than the first group is not recorded whenever accessed, but at least the information with the higher priority is recorded more frequently.

According to still another aspect of the invention, there is provided an image forming apparatus including a development portion holder that is mounted with a plurality of development portions having a memory storing plural types of information on the corresponding development portion and that selectively portions one of the development portions in a predetermined development positions by holding and moving the mounted development portions; a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority and the plural types of information are grouped into Ng groups from a first group with the highest priority to an Ng-th group (where Ng is a natural number of 2 or more) with the lowest priority by the priority, wherein in the image forming process, the controller determines the number of groups which can be written by the access unit on the basis of how long the respective development portions stays at the access position, and wherein the access unit records the information belonging to the groups of the number determined by the controller in the memory sequentially from the first group by priority.

According to still another aspect of the invention, there is provided an image forming method of selectively positioning a plurality of development portions in a corresponding predetermined development position, forming an image using the respective development portions positioned at the development position, and accessing a memory of the respective development portions positioned at an access position different from the development position to perform an image forming process of writing plural types of information on the development portion, the image forming method including: predetermining the plural types of information in priority so as to group the plural types of information into Ng groups sequentially from a first group with the highest priority to an Ng-th group (where Ng is a natural number of 2 or more) with the lowest priority by the priority; determining the number of storable groups of the Ng groups on the basis of how long the respective development portions stays at the access position; and writing the information belonging to the groups of the determined number of the groups from the first group by the priority.

In the image forming apparatus with the above-described configuration, the number of groups to be recoded varies on the basis of how long the development portions stay at the access position. In addition, the information is sequentially recorded from the first group to the recordable groups. For example, in one case, only the information belonging to the first group is recorded. In addition, in another case, the information belonging to the first and second groups is recorded. In this way, since the time necessary to record the information varies by writing the information on the group number on the basis of how long the development portions stay, it is possible to flexibly meet the case where a staying time of the development portions varies. Moreover, since the writing process is sequentially performed from the first group by the priority in this case, the significant information can be updated more reliably.

According to still another aspect of the invention, there is provided an image forming apparatus including a development portion holder that is mounted with a plurality of development portions having a memory storing plural types of information on the corresponding development portion and that selectively portions one of the development portions in a predetermined development positions by holding and moving the mounted development portions; a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority and the plural types of information are grouped into Ng groups from a first group with the highest priority to an Ng-th group (where Ng is a natural number of 2 or more) with the lowest priority by the priority, wherein the access unit records the information belonging to the group sequentially from the first group by the priority on the basis of the control instruction of the controller, and wherein the controller determines whether to allow the access unit to record the information belonging to the next group on the basis of the time until the respective development portions starts movement from the access position, and gives a control instruction to the access unit on the basis of the determination result.

According to still another aspect of the invention, there is provided an image forming method of selectively positioning a plurality of development portions in a predetermined corresponding development position, forming an image using the respective development portions positioned at the development position, and accessing a memory of the respective development portions positioned at an access position different from the development position to perform an image forming process of writing plural types of information on the development portion, the image forming method including: predetermining the plural types of information in priority so as to group the plural types of information into Ng groups sequentially from a first group with the highest priority to an Ng-th (where Ng is a natural number of 2 or more) group with the lowest priority by the priority; writing the information belonging to the group sequentially from the first group by the priority; and determining whether to allow the access unit to record the information belonging to the next group on the basis of the time until the development portions starts movement from the access position whenever writing the information belonging to one group.

In the image forming apparatus with the above-described configuration, the information is recorded on the memory by the priority. However, whether the information on the next group is recorded or not depends on the period of time until the development portions start to movement after writing one group. Accordingly, the number of groups to be written depends on the period of time how long the development portions stay at the access position. With such a configuration, it is possible to flexibly meet the case where the staying time of the respective development portions varies. Moreover, since the writing process is sequentially performed from the first group by the priority in this case, the significant information can be updated more reliably.

The advantage of the invention is particularly effective in the image forming apparatus in which the controller can perform a plurality of image forming modes in which the periods of time how long the respective development portions stay at the access position are different. In such an image forming apparatus, since the periods of the time how long the respective development portions stay are different by the performed modes. Accordingly, by changing the number of groups to be written in accordance with the periods of time, it is possible to record the necessary information at appropriate timing.

According to the image forming apparatus having the above-described configuration, the highest priority may be given to the lifetime information when the plural types of information include lifetime information used for the controller to manage a lifetime of the respective development portions. In this way, it is possible to appropriately carry out the lifetime management of the respective development portions.

In particular, the advantage is considerably effective in a case where the lifetime information varies with the use of the respective development portions. The reason is because when the information varying in such a manner is not updated and the respective development portions are detached from the image forming apparatus, the information stored in the memory does not show the right status of the respective development portions. Accordingly, the lifetime management of the respective development portions may not be appropriately carried out. In order to avoid such a circumstance, the information which varies with the use of the respective development portions may be recorded most preferably.

BRIEF DESCRIPTION OF THE DRAWINGS

The invention will be described with reference to the accompanying drawings, wherein like numbers reference like elements.

FIG. 5 is a diagram illustrating a memory map showing information contents of a memory chip.

DESCRIPTION OF EXEMPLARY EMBODIMENTS

Configuration of Apparatus

Figure 1:
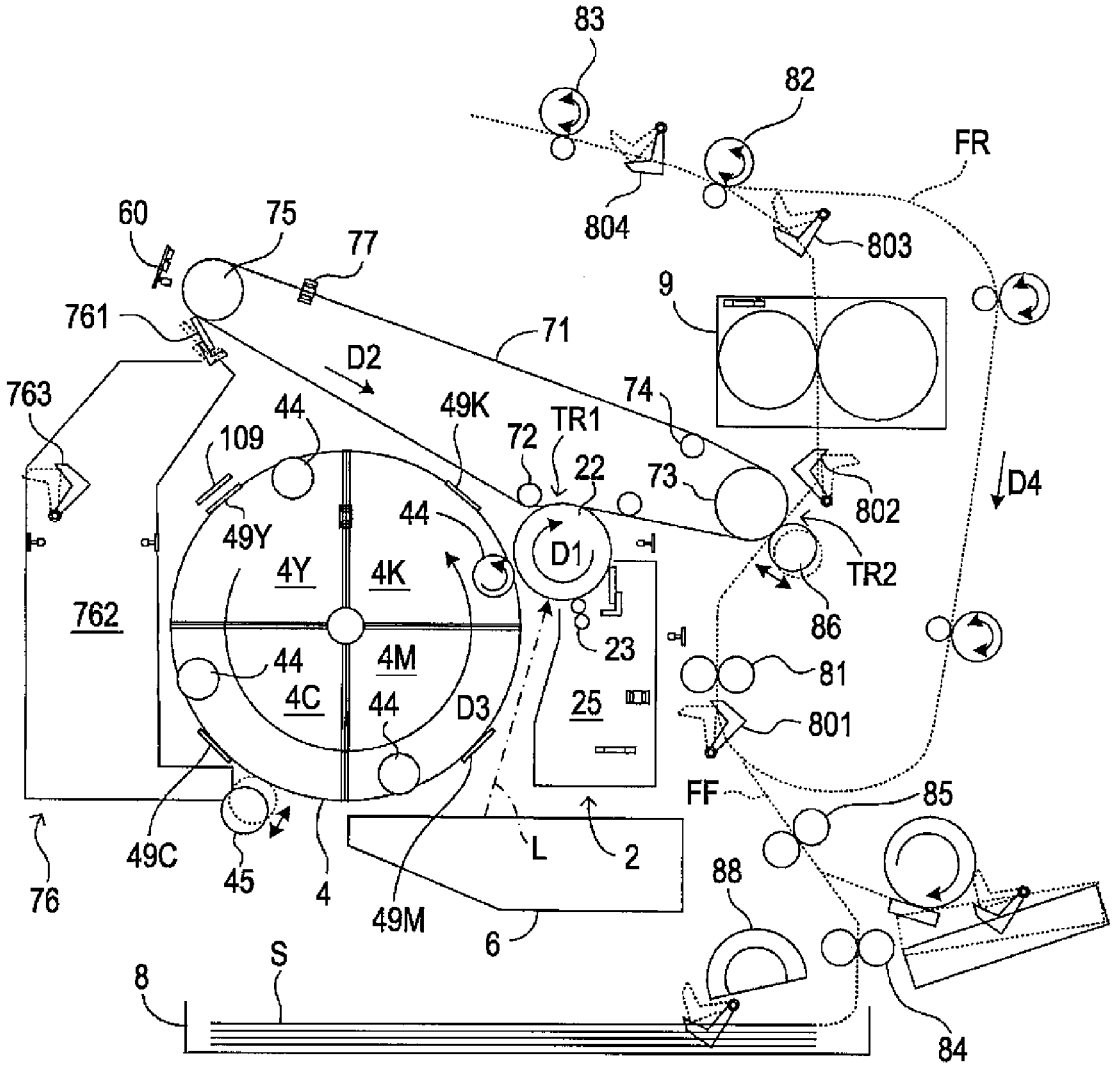
FIG. 1 is a diagram illustrating a configuration of an image forming apparatus according to the invention.
Figure 2:
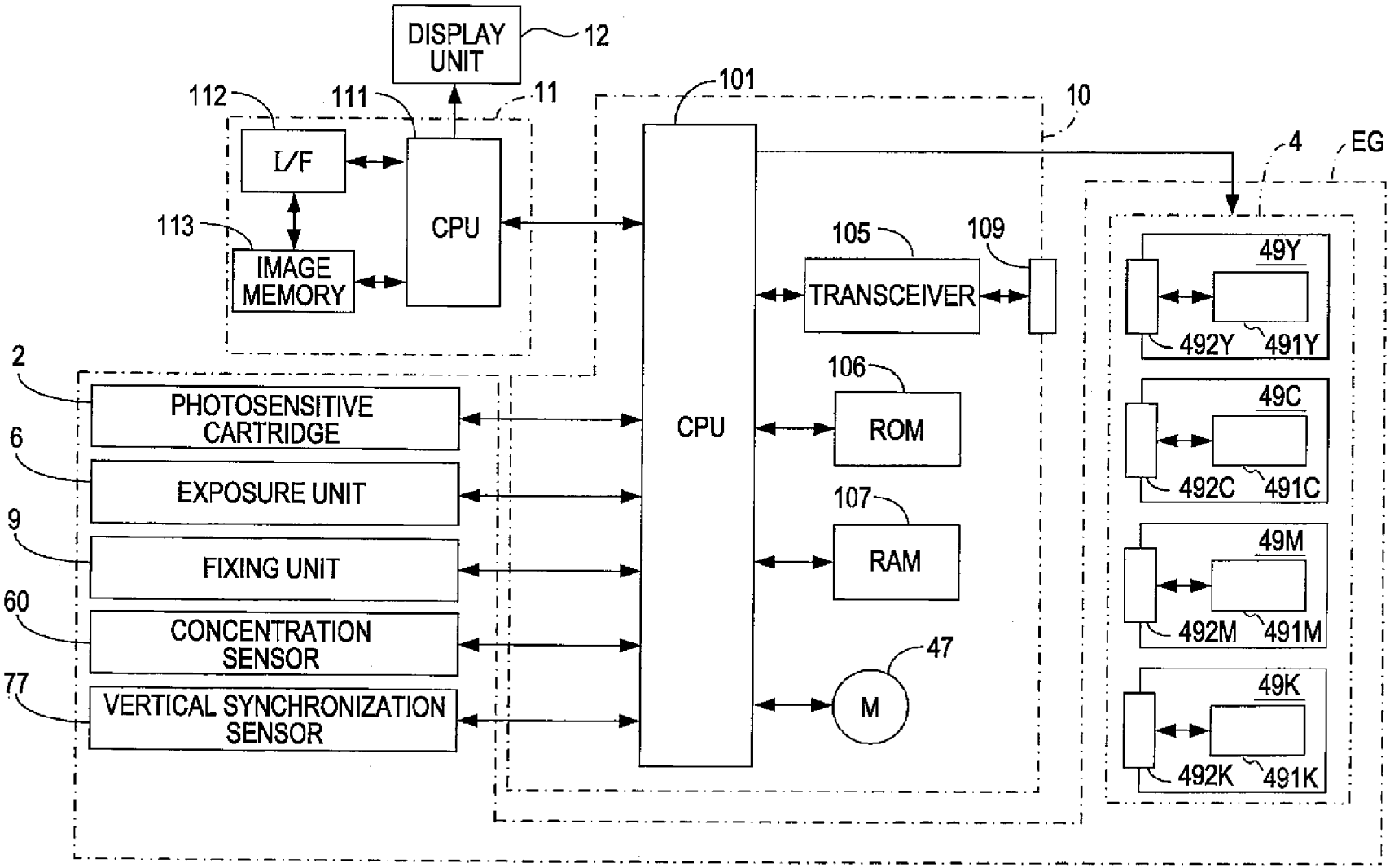
FIG. 2 is a block diagram illustrating an electrical configuration of the image forming apparatus shown in FIG. 1.

FIG. 1 is a diagram illustrating a configuration of an image forming apparatus according to the invention. FIG. 2 is a block diagram illustrating an electrical configuration of the image forming apparatus shown in FIG. 1. The image forming apparatus forms a full color image by overlapping four-color toners (developer) of yellow (Y), cyan (C), magenta (M), and black (K) or forms a black-and-white image using a black toner of black (K). When an image signal is transmitted from an exterior apparatus such as a host computer to a main controller 11, a CPU 101 disposed in engine controller 10 controls each unit of a engine EG according to an instruction of the main controller 11 to perform a predetermined image forming process and the image forming apparatus forms an image corresponding to the image signal on a sheet S.

In the engine EG, a photosensitive member 22 is rotatably provided in an arrow rotation direction D1 shown in FIG. 1. An electric charge roller 23, a rotary development unit 4, and a cleaning portion 25 are disposed in the vicinity of the photosensitive member 22 along the rotation direction D1. Since a predetermined electric charge bias is applied, the electric charge roller 23 electrifies an outer peripheral surface of the photosensitive member 22 with a predetermined surface potential. The cleaning portion 25 removes toner remaining on a surface of the photosensitive member 22 after a first transcription and recovers the toner in a disuse toner tank disposed inside. The photosensitive member 22, the electric charge roller 23, and the cleaning portion 25 are incorporated with a photosensitive member cartridge 2. The photosensitive member cartridge 2 can be attached to or detached from an apparatus main body.

Optical beams L are emitted from an exposure unit 6 toward the outer peripheral surface of the photosensitive member 22 electrified by the electric charge roller 23. The exposure unit 6 exposes the optical beams L on the photosensitive member 22 in accordance with the image signal transmitted from the exterior apparatus to form an electrostatic latent image corresponding to the image signal.

The electrostatic latent image formed in this manner is developed with toner by the development unit 4. In the image forming apparatus, the development unit 4 includes a support frame 40 rotatably provided on a rotation axis perpendicular to a sheet surface in FIG. 1. The development unit 4 includes a development portion 4Y for a yellow color, a development portion 4C for a cyan color, a development portion 4M for a magenta color, and a development portion 4K for a black color which are detachably mounted on the support frame 40 and each have a nonmagnetic monocomponent toner of each color. The development unit 4 is rotatably driven in an arrow direction D3 by a development unit driving motor 47 which is a stepping motor controlled by the engine controller 10. In addition, a rotary lock 45 which comes in contact with or breaks in contact with the development unit 4 is provided in the apparatus main body. Whenever necessary, the rotary lock 45 serves as a break or a lock mechanism that allows the development unit 4 to be positioned at a predetermined position, which is a staying position, by coming in contact with the periphery of the support frame 40 of the development unit 4 to stop the rotation of the development unit 4.

When the development unit 4 is rotatably driven in accordance with the control instruction of the engine controller 10 and the development portions 4Y, 4C, 4M, and 4K are selectively positioned at a development position opposite the photosensitive member 22, development rollers 44 which are disposed in the development portions and keep selected color toners are each opposed to the photosensitive member 22 so as to be separated by a predetermined gap. In addition, toners are given on a surface of the photosensitive member 22 from the development rollers 44. In this way, an electrostatic latent image on the photosensitive member 22 is developed in the selected toner color.

A toner image developed to the development unit 4 in the above-described manner is transferred from a first transfer region TR1 onto an intermediate transfer belt 71 of a transfer unit 7. The transfer unit 7 includes the intermediate transfer belt 71 suspended on a plurality of rollers 72 to 75 and a driving mechanism (not shown) rotating the intermediate transfer belt 71 in a predetermined rotation direction D2 by rotatably driving the roller 73. In a case of transferring a color image onto a sheet S, the color image is formed by overlapping the toner image of each color formed on the photosensitive member 22 onto the intermediate transfer belt 71 and the color image is transferred a second time onto the sheet S transported from a cassette 8 to a second transfer region TR2 along a transport passage FF.

The second transfer region TR2 is a nip region which comes in contact with a surface of the intermediate transfer belt 71 suspended on the roller 73 and a second transfer roller 86 coming in contact with and breaking in contact with the belt surface. The sheet S that is stacked in the cassette 8 is taken out one by one by rotation of a pick-up roller 88, and then loaded on the transfer passage FF. Subsequently, the sheet S is transported to the second transfer region TR2 along the transport passage FF by rotation of feed rollers 84 and 85 and gate roller 81.

It is required to control timing when the sheet S is transported to the second transfer region TR2 in order to appropriately transfer the image on the intermediate transfer belt 71 onto a predetermined area of the sheet S. Specifically, the gate roller 81 are disposed in the front of the second transfer region TR2 and a front-side gate sheet detecting sensor 801 is also disposed in the front of the second transfer region TR2 on the transfer passage FF. Subsequently, when the sheet S transported along the transport passage FF is detected by the front-side gate sheet detecting sensor 801, the transporting of the sheet S stays for a while and the sheet s is synchronized with the timing of a circular movement of the intermediate transfer belt 71 to resume the rotation of the gate roller 81. So, the sheet S is transported to the second transfer region TR2 at a predetermined timing. In this way, the toner image formed on the intermediate transfer belt 71 is transferred onto a surface of the sheet S passing through the second transfer region TR2 the second time.

The toner image is fixed on the sheet S on which the color image is formed in this way by a fixing unit 9, and then is transported to a discharging tray unit 89 disposed in the top portion of the apparatus main body via a front-side discharging roller 82 and a discharging roller 83. In addition, in a case of forming images on both surfaces of the sheets S, a rear end of the sheet S in which the image is formed on one surface in the above-described manner is transported to a reverse position in the rear of the front-side discharging roller 82. At this time, the sheet S is transported in an arrow direction D4 along a reverse transport passage RF by reversing the rotation direction of the discharging roller 83. Subsequently, the sheet S is loaded on the transport passage again before the gate roller 81. However, the surface of the sheet S which comes in contact with the intermediate transfer belt 71 and onto which the image is transferred is the surface opposite the surface on which the image is transferred beforehand. In this way, it is possible to form the images on both surfaces of the sheet S.

In addition to the front-side gate sheet detecting sensor 801, sheet detecting sensors 802 to 804 for detecting whether the sheet S passes on the transport passages are disposed on the sheet transport passage FF and the reverse transport passage RF. In addition, on the basis of outputs of the above-described sensors, it is possible to control the sheet transport timing and to detect jam of the sheet S in the positions.

A cleaner 76 is disposed in the vicinity of the roller 75. The cleaner 76 includes a cleaner blade 761 which can be moved close to or be separated from the roller 75 by an electromagnetic clutch (not shown) and a waste tank 762. The cleaner blade 761 which moves close to the roller 75 comes in contact with the surface of the intermediate transfer belt 71 suspended on the roller 75 in order to remove the toner remaining on the outer peripheral surface of the intermediate transfer belt 71 after the second transferring process. The removed toner piles in the waste tank 762. The waste tank 762 includes a waste sensor 763 which can detect whether the waste tank 762 is full with the toner.

When the image is transferred onto the sheet S in the second transfer region TR2, the cleaner blade 761 comes in contact with or breaks in contact with the intermediate transfer belt 71 in order to remove the toner remaining on the intermediate transfer belt 71 at the same circular time. For example, when black and white image is successively formed, the image transferred onto the intermediate transfer belt 71 in the first transfer region TR1 is immediately transferred onto the sheet S in the second transfer region TR2. Accordingly, the cleaner blade 761 continues to come in contact with the intermediate transfer belt 71. Alternatively, in a case of forming a color image, it is required that the cleaner blade 761 breaks in contact with the intermediate transfer belt 71 while overlapping the toner image of each color. Subsequently, when finishing the full color image by overlapping the toner image of each color, the cleaner blade 761 comes in contact with the intermediate transfer belt 71 in order to remove the remaining toner at the same circular time as the second transferring.

A concentration sensor 60 and a vertical synchronization sensor 77 are disposed in the vicinity of the roller 75. The concentration sensor 60 is disposed so as to be opposed to the surface of the intermediate transfer belt 71. If necessary, the concentration sensor 60 measures an image concentration of the toner image formed on the outer peripheral surface of the intermediate transfer belt 71. In addition, on the basis of the measurement result, the image forming apparatus adjusts operational conditions which have an effect on an image quality. Examples of the operation conditions include a development bias given to the respective development portions and a magnitude of the optical beams L. The concentration sensor 60 is configured to output a signal corresponding to an image concentration on a predetermined area of the intermediate transfer belt 71 using, for example, a reflective photo sensor. Moreover, a CPU 101 can detect the image concentration of the entire parts of the toner image on the intermediate transfer belt 71 by periodically sampling the output signal from the concentration sensor 60 while circularly moving the intermediate transfer belt 71.

The vertical synchronization sensor 77, which is a sensor for detecting a reference position of the intermediate transfer belt 71, can also serve as a sensor for obtaining a synchronization signal output in relation to the rotational drive of the intermediate transfer belt 71, that is, a vertical synchronization signal Vsync. In addition, the apparatus controls the operation of each unit on the basis of the vertical synchronization signal Vsync in order to synchronize the operational timing of each unit and exactly overlap the toner image formed with each color.

Memory tags 49Y, 49C, 49M, and 49K are attached to the peripheral surfaces corresponding to the development portions 4Y, 4C, 4M, and 4K of the development unit 4 which has overall a substantially cylindrical shape. For example, the memory tag 49Y mounted in the yellow development portion 4Y includes a memory chip 491Y storing a manufacture lot or a use history of the development portion 4Y and data on a quantity remaining in built-in toner, and the like and a loop antenna 492Y electrically connected to the memory 491Y. In addition, memory chips 491C, 491M, and 491K and loop antennas 492C, 492M, and 492K are mounted in the memory tags 49C, 49M, 49K of the other development portions, respectively.

A wireless communication antenna 109 is disposed in the apparatus main body. The wireless communication antenna 109, which is driven by a transceiver 105 connected to the CPU 101, allows data to be transmitted and received between the memories mounted in the CPU 101 and the development portions as wireless communication antennas of the development portions perform wireless communication. At this time, management for various types of information such as management of consumption goods for the development portions is performed.

As shown in FIG. 2, the image forming apparatus includes a display unit 12 controlled by a CPU 111 of a main controller 11. The display unit 12, which is configured by, for example, a liquid crystal display, displays a predetermined message for informing an operation guide of a user, a proceeding status of the image forming process, an error of the apparatus, exchanging time of any unit, or the like on the basis of the control instruction of the CPU 111.

As shown in FIG. 2, an image memory 113 which stores images transmitted from an external device via an interface 112 is provided in the main controller 11. A ROM 106 stores a calculation program executed by the CPU 101 or control data for controlling an engine unit EG. A RAM 107 temporarily stores calculation results of the CPU 101 or other data.

Figure 3A:
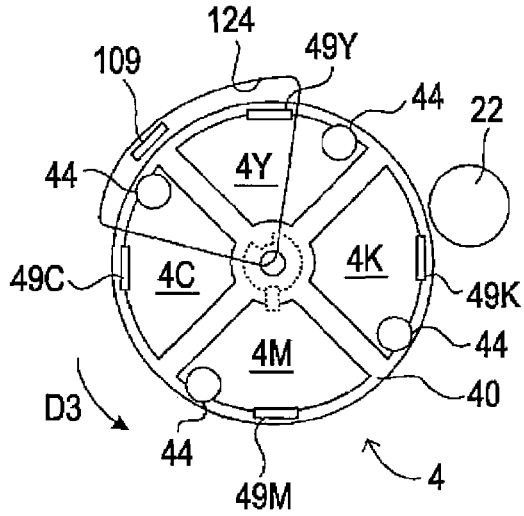
FIGS. 3A to 3C are schematic diagrams illustrating a staying position of a development unit.
Figure 3B:
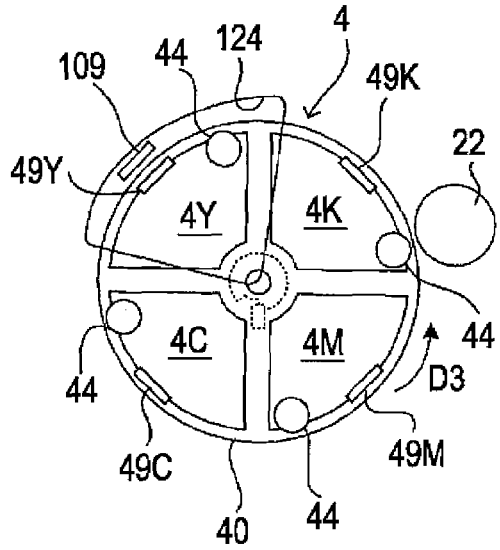
Figure 3C:
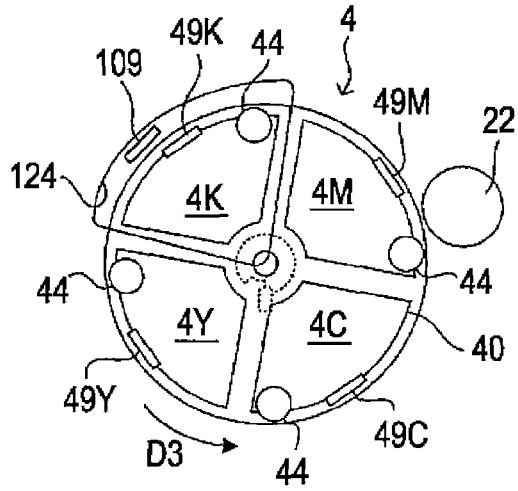

FIGS. 3A to 3C are schematic diagrams illustrating a staying position of the development unit 4. The development unit 4 is placed and fixed on 3 positions shown in FIGS. 3A to 3C by the development unit driving motor 47 and the rotary lock 45. The 3 positions refer to a home position, an image formation position, and a detachment position. The home position is a position in which the development unit 4 is placed when the image forming apparatus does not perform image forming process. As shown in FIG. 3A, the development rollers 44 disposed in the development portion 4Y are all separated from the photosensitive member 22.

The image formation position is a position in which the respective development portions are positioned when the electrostatic latent image of the photosensitive member 22 is developed to selected toner color. As shown in FIG. 3B, the development roller 44 (in FIG. 3B, the development roller 44 provided in the black development portion 4K) mounted in one development portion is opposed to the photosensitive member 22. As a predetermined development bias is applied, the electrostatic latent image is developed with the toner. In the embodiments, when the development unit 4 is in the image formation position, a position of the development portion (in the FIG. 3B, the black development portion 4K) of which the development roller 44 is opposed to the photosensitive member 22 refers to "a development position".

In addition, the detachment position is a position used only when the respective development portions are attached or detached. When the development unit 4 is in the detachment position, as shown in FIG. 3C, one development portion is moved to an opening 124 formed on a side surface of an outer chassis of the image forming apparatus so as to be taken out. FIG. 3*c* shows that the black development portion 4K is moved to the opening 124. Moreover, a new development portion can be mounted in the support frame 40 in which the development portion is not mounted. When the development unit 4 is in the detachment position, all the development rollers 44 mounted in the development portions are separated from the photosensitive member 22. In this way, when the development unit 4 is in the detachment position, it is possible to take out only one development portion moved to the opening 124. That is, when the development unit 4 is in the home position shown in FIG. 3A or the image formation position shown in FIG. 3B, it is not possible to take out any development portion. Accordingly, a user cannot damage the image formation apparatus by attaching or detaching the development portions carelessly. In addition, in the image forming apparatus, the above-described image formation position and the detachment position are configured in each of the four development portions 4Y, 4M, 4C, and 4K.

When the development unit 4 is positioned at the development position, as shown in FIG. 3B, the wireless communication antenna disposed in one development portion is placed so as to be opposed to the wireless communication antenna 109 of the apparatus main body. In FIG. 3B, when the development roller 44 of the development portion 4K is opposed to the photosensitive member 22, the wireless communication antenna 492Y disposed in the development portions 4Y positioned in a downstream-side adjacent position in the rotation direction D3 of the development unit 4 in view of the development portion 4K is placed so as to be opposed to the wireless communication antenna 109 of the apparatus main body. At this time, the wireless communication antenna 109 of the apparatus main body communicates with the wireless communication antenna 492Y in order to read the information stored in the memory 491Y disposed in the development portions 4Y. In addition, new information is stored in the memory 491Y. The position of the respective development portions when the antenna of the development portions is opposed to the antenna 109 of the apparatus main body refers to "an access position". That is, in FIG. 3B, the yellow development portion 4Y is positioned at the access position.

In the image forming apparatus having the above-described configuration, it is possible to perform a color image formation mode in which an image is formed by using the four development portions 4Y, 4M, 4C, and 4K and a black-and-white image formation mode in which an image is formed by using, for example, only the black development portion 4K. In addition, in each mode, there are an operation mode (one-image formation operation) in which one image is formed and an operation mode (two-image formation process) in which two images are successively formed while the intermediate transfer belt 71 rotates once. When several images are successively formed, the two-image formation process in which throughput is higher is generally selected to perform the image formation process. Alternatively, when only one image is formed or when a size of an image to be formed is large and so two images cannot be formed in a line on the intermediate transfer belt 71, the one-image formation operation is selected.

In the image forming apparatus, the development unit is switched immediately after one development portion finishes the image forming process. That is, when the application of the development bias to the development portion which is in the development position finishes, the rotation of the development unit 4 starts immediately. That is because of obtaining a good image quality. That is, in the image forming apparatus for forming an image by switching the development portions, when one development portion finishes forming the image, the next development portion is moved to the development position and the electrostatic latent image is developed by applying the development bias. At this time, since it takes time a little to stabilize the rotation or a bias voltage of the development rollers 44, a quality of the image at the time of starting development may be unstable. In order to avoid this phenomenon, it is desirable to move the development portions to the development position as soon as possible to start the rotation of the development rollers and the application of the development bias. Accordingly, in the image forming apparatus, the development unit 4 is configured so as to start rotation as soon as possible after the development process, more specifically, after the application of the development bias.

When the respective development portions are switched, the development portions in the corresponding development position move to the corresponding access position in which it is possible to communicate with the wireless communication antenna 109 of the apparatus main body. In this way, while performing the image forming process using the respective development portions in the corresponding development position, it is possible to access the memory of the respective development portions in the corresponding access position. In the image forming apparatus, a lifetime management of the development portions is performed on the basis of the information on the use status of the development portions stored in the memory chips of the development portions. For example, the lifetime management of the development portions is carried out in a manner in which the stored toner residual quantity of the respective development portions is updated by calculating a toner quantity consumed to form an image from the image data and writing a value obtained by subtracting the consumed toner quantity from the toner quantity stored in the memory chip of the respective development portions. Since the toner residual quantity is also stored in the RAM 107 of the engine controller 10, a reading or writing in the memory chips may be not necessarily performed every time of calculating the toner residual quantity. However, in order to prevent the latest toner residual quantity from being not stored in the respective development portions when the respective development portions are taken out, the image forming apparatus accesses the memory chips every time of forming the image and updates the information on the use status of the respective development portions changed by using the toner.

In the two-image formation process, two images are formed while the intermediate transfer belt 71 rotates once. Afterward, the rotary development unit 4 rotates in order to switch the development portions. Alternatively, in the one-image formation operation, only one image is formed when the intermediate transfer belt 71 rotates once. Accordingly, when finishing the formation of one image (application of the development bias), the development unit 4 starts to rotate. At this time, between the two-image formation operation and the one-image formation process, periods of time how long the development unit 4 stays are not necessarily equal. Moreover, in the one-image formation process, the period of time how long the development unit 4 stays varies in accordance with a size of the image to be formed.

When the development unit 4 starts to rotate as soon as possible in this way after the development, the staying periods of time of the development unit 4 at the time of performing the image formation process may not be necessarily equal. As a result, the staying periods of the time when the development portions stay may not be equal. Some time is necessary to store information in the memory chips. Accordingly, when the period of time when the development portions becomes shorter, time required to store all necessary information may not be sufficient. When access to the memory chips is not finished, reliability of the information stored in the memory chips of the development portions is damaged, thereby having a bad effect on the lifetime management. In order to prevent such a situation, the image forming apparatus allows the CPU 101 to perform the following processes including the access to the memory chips.

Figure 4:
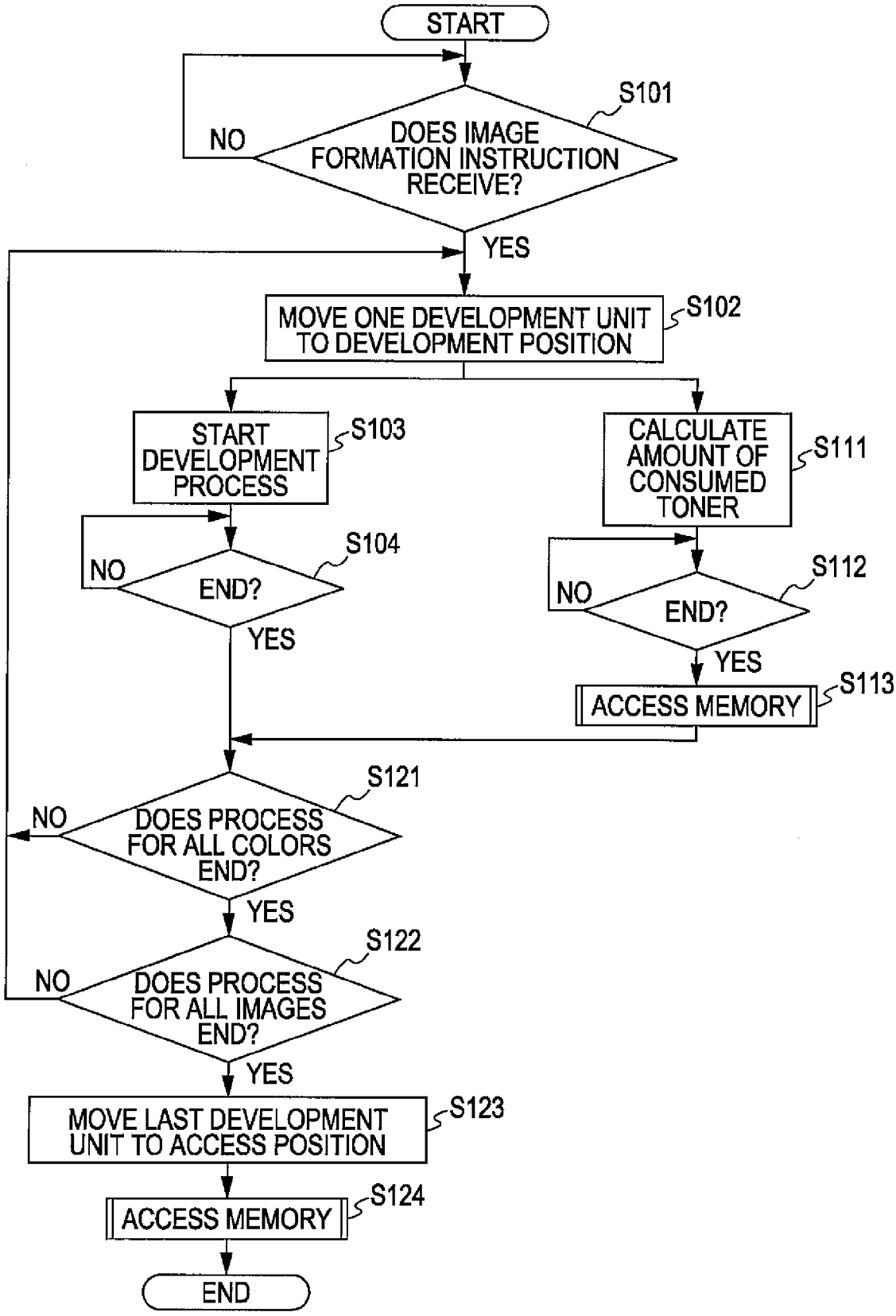
FIG. 4 is a flowchart illustrating an image forming process in the image forming apparatus.

FIG. 4 is a flowchart illustrating the image forming process in the image forming apparatus. A formation of the electrostatic latent image and a process of forming the toner image are known and the overview thereof is described above. Accordingly, hereinafter, the detail description of processes except for the development process will be omitted unless the invention is related.

When receiving an image formation instruction from a user, a host computer, or the like (Step S101), the image formation process is started. First, one development portion is positioned at the development position by rotating the development unit 4 (Step S102), and then the development process is started by applying a predetermined development bias to the respective development portions (Step S103). In this case, the development process is performed in an order of the black development portion 4K, the magenta development portion 4M, the cyan development portion 4C, and the yellow development 4Y in accordance with a positional relation in the development unit 4. However, the invention is not limited thereto.

A toner quantity consumed by the respective development portions in order to form an image is calculated on the basis of the image data representing a content of the image to be formed (Step S111). At this time, the consumed toner quantity to be calculated does not belong to the development portion which is in the development position now and used in the present development process, but belongs to the development portion which is in the development position beforehand and in the access position now. That is because it is practically not possible to calculate the consumed toner quantity at the same time of performing the development process since the consumed toner quantity cannot be calculated unless all the image data is received. Moreover, the access to the memory chip of the respective development portions used in the present development process is performed after the corresponding development portion is moved to the access position, and at the present time, it is not necessary to complete the calculation of the consumed toner quantity.

Furthermore, only when the image formation process is just started and a first development portion is in the development position, it is not necessary to perform the memory access to the development portion which is in the access position at such a time. That is because the development portion is not yet used. Accordingly, it is not necessary to perform the memory access to the development portion initially positioned at the access position. In addition, a variation quantity of information which varies in accordance with the use like the consumed toner quantity may be set to zero to perform the access like other cases.

When the calculation of the consumed toner quantity ends (Step S112), the memory access process described below is performed (Step S113) to update necessary information by reading or writing the information stored in the memory chip of the development portion in the access position.

Meanwhile, when the development process performed along with such processes ends (Step S104), the above-described processes are reiterated for all the necessary toner colors (Step S121). Subsequently, the necessary images are formed by again reiterating the processes until completing formation of all the necessary images (Step S122). At this time, however, since the information of the memory chip on the last used development portion is not updated, the last used development portion is positioned at the access position (Step S123). Subsequently, the memory access process is performed (Step S124), and then the process ends.

In Step S104, "the completion of the development process" does not mean that the development process of forming all necessary images is not completed, but means that the development process to be successively performed at the time of placing one development portion is completed. When forming the color image, the image forming apparatus allows the respective development portions to be switched once every rotation of the intermediate transfer belt 71. Accordingly, in the one-image formation process of forming one image on the intermediate transfer belt 71, the completion of the development process for one image corresponds to "a completion of the development process". Alternatively, in the two-image formation process of forming two images on the intermediate transfer belt 71 corresponds to "the completion of the development process". When forming the black-and-while image, the black development portion 4K is positioned at the development position. At this time, since the necessary images are successively formed, the completion of the development process for all images corresponds to "the completion of the development process".

FIG. 5 is a diagram illustrating a memory map showing information contents of a memory chip. A memory space of the respective memory chips is divided into a plurality of banks. Different types of information are stored in the respective banks. An information reading and writing process by means of access to the apparatus main body is performed by a bank unit. The information is stored in the memory chip of the respective development portions and is also backed up in the RAM 107 disposed in the apparatus main body.

Information (identification information of the respective development portions) required to identify the development portions is stored in a first bank. Specifically, as the identification information of the respective development portions, a toner color, a manufacture lot No., or the like stored by the corresponding development portion can be used. This information is unique information given at the time of manufacturing the development portions and is not changed when used. Accordingly, this information is read from the memory chips to identify the development portions. However, since this information is not required to update as using the development portions, this information is just read in the access to the first bank. Only the reading process is necessary in the access to the first bank. In FIG. 5, "R" in "an access type" column means that the corresponding bank is used only for the reading process.

Information (information for a lifetime management) required to manage the lifetime management of the respective development portions is stored in a second bank. Specifically, as the information on the lifetime management, the total operation time of the development rollers 44 indicating the toner residual quantity of the corresponding development portion and deterioration of the corresponding development portion can be used. This information is changed as using the development portions. Accordingly, it is desirable to frequently update this information. Because of this, both the reading and writing processes are necessary in the access to the second bank. In FIG. 5, "R/W" in the "access type" column means that the corresponding bank is used for both the reading and writing processes. By storing and managing this types of the information in the apparatus main body as well, and then comparing the information stored in the apparatus main body to that read from the development portions, it is possible to confirm characteristics or the process of the development portions.

Information (information except for the lifetime management) which is changed as using the development portions, but is not directly used in the lifetime management is stored in a third bank. Specifically, as the information except for the lifetime management, the number of detachment from the corresponding development portion, a development setting value, or the like can be used. In addition, information (apparatus main body) on use status of the main body of the image forming apparatus which mounts and operates the corresponding development portion is stored in a fourth bank. As the information on the apparatus main body, for example, the number of forming images, the total operation time, or the like can be used. This information is not directly used in the lifetime management of the development portions. However, by preserving this information in the development portions, for example, the development portions can be determined whether to be re-used on the basis of this information which is stored in the waste development portions recovered from a user. Alternatively, when the image forming apparatus or the development portions are broken down, it can be helpful to find the cause. Both the reading and writing processes are necessary in the access to the third bank for storing the information except for the lifetime management and the fourth bank for storing the information of the apparatus main body.

In the image forming apparatus, the types of information is stored in the four divided banks of the memory chip of the respective development portions. The banks to be written from the apparatus main body are the second to fourth banks except for the first bank only for reading process. One group of information stored in the second to fourth banks forms one "group" according to the invention, and therefore, the number Ng of groups according to the invention corresponds to "3" in the image formation apparatus.

The information required to identify the development portions is stored in the first bank only for the reading process. The information is primary information for managing the development portions. Accordingly, when the access to the first bank is performed, the reading process is performed and the read information is used to identify the development portions.

Meanwhile, the second to fourth banks to be written are predetermined in the priority. Specifically, the priority is given in an order of the second bank, the third bank, and the fourth bank. The information supplied to the lifetime management of the development portions is stored in the second bank. If reliability of the information is deteriorated, the lifetime management cannot be appropriately performed. Accordingly, since the second bank is the most significant, the higher priority is given to the second bank. The information on the use status of the development portions is stored in the third bank, but is not directly used in the lifetime management. Accordingly, even when the information is lost, the lifetime management is not affected, and thus the priority lower than the priority given to the second bank is given to the third bank. In addition, the information on the apparatus main body is stored in the fourth bank and can be managed in the apparatus main body and the other development portions. Accordingly, the lowest priority is given to the fourth bank.

The priority is set to the types of information in order to deal with a change in the period of time how long the development unit 4 stays to form the image as described above. More specifically, when the development unit 4 stays for a short time, the access to the memory chips cannot be completed. Accordingly, a failure in the lifetime management can be avoided by setting the priority. That is, in the image forming apparatus, when the information required for the memory chips is written, writing all the information with one access is not a requisite. Accordingly, it is possible to shorten time required for the access, and even when the development unit 4 stays for a short time, it is possible to reliably complete the information writing. Hereinafter, the memory access process according to four embodiments of the invention will be described one by one.

First Embodiment

Figure 6:
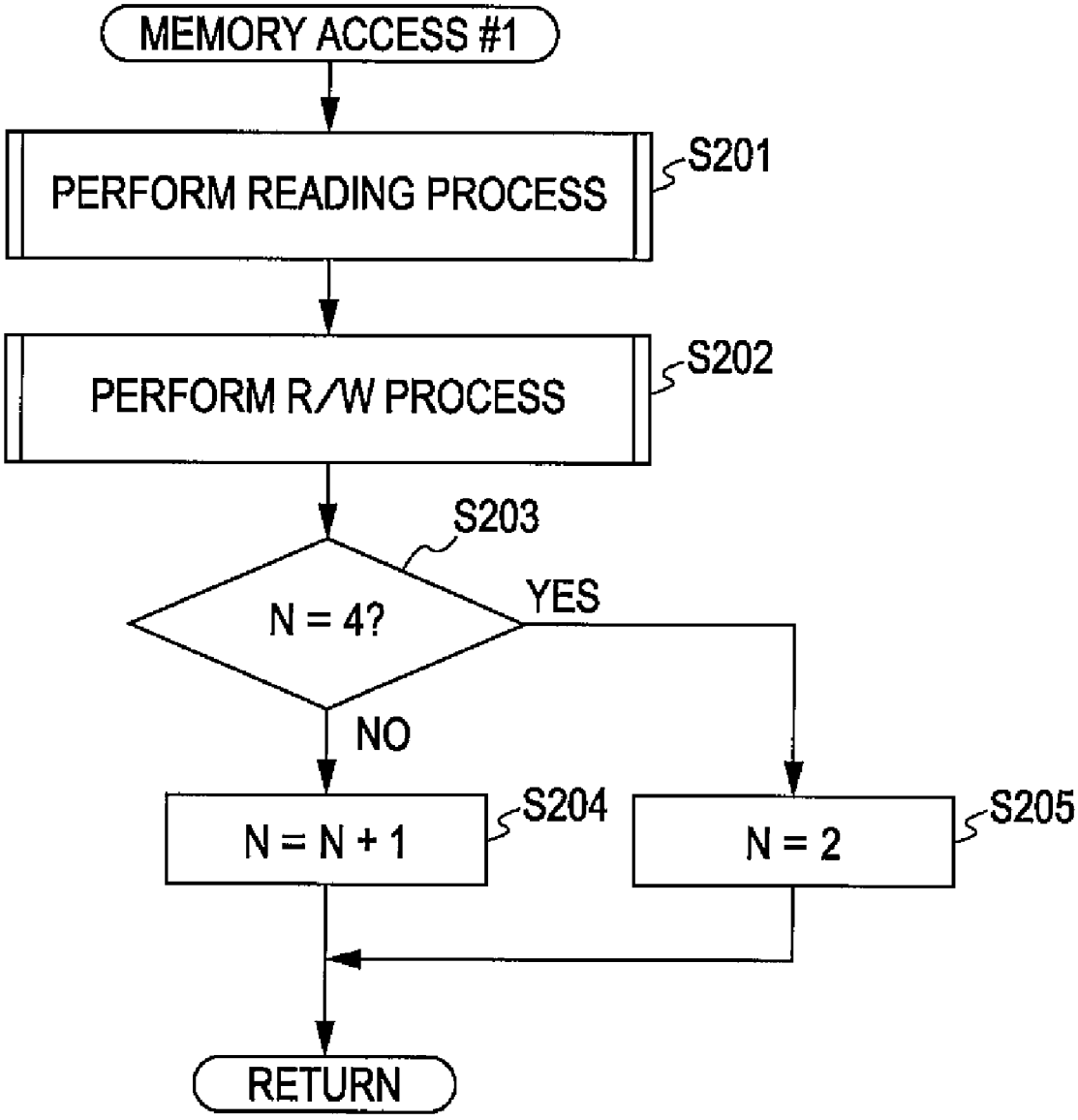
FIG. 6 is a flowchart illustrating a memory access process according to a first embodiment.

FIG. 6 is a flowchart illustrating the memory access process according to a first embodiment. In a memory access process according to the first embodiment, after reading data from a first bank, data is read from and written in one bank among second to fourth banks. Hereinafter, the reading and writing processes will be described in detail. First, in the process, the reading process of the data stored in the first bank proceeds (Step S201).

Figure 7:
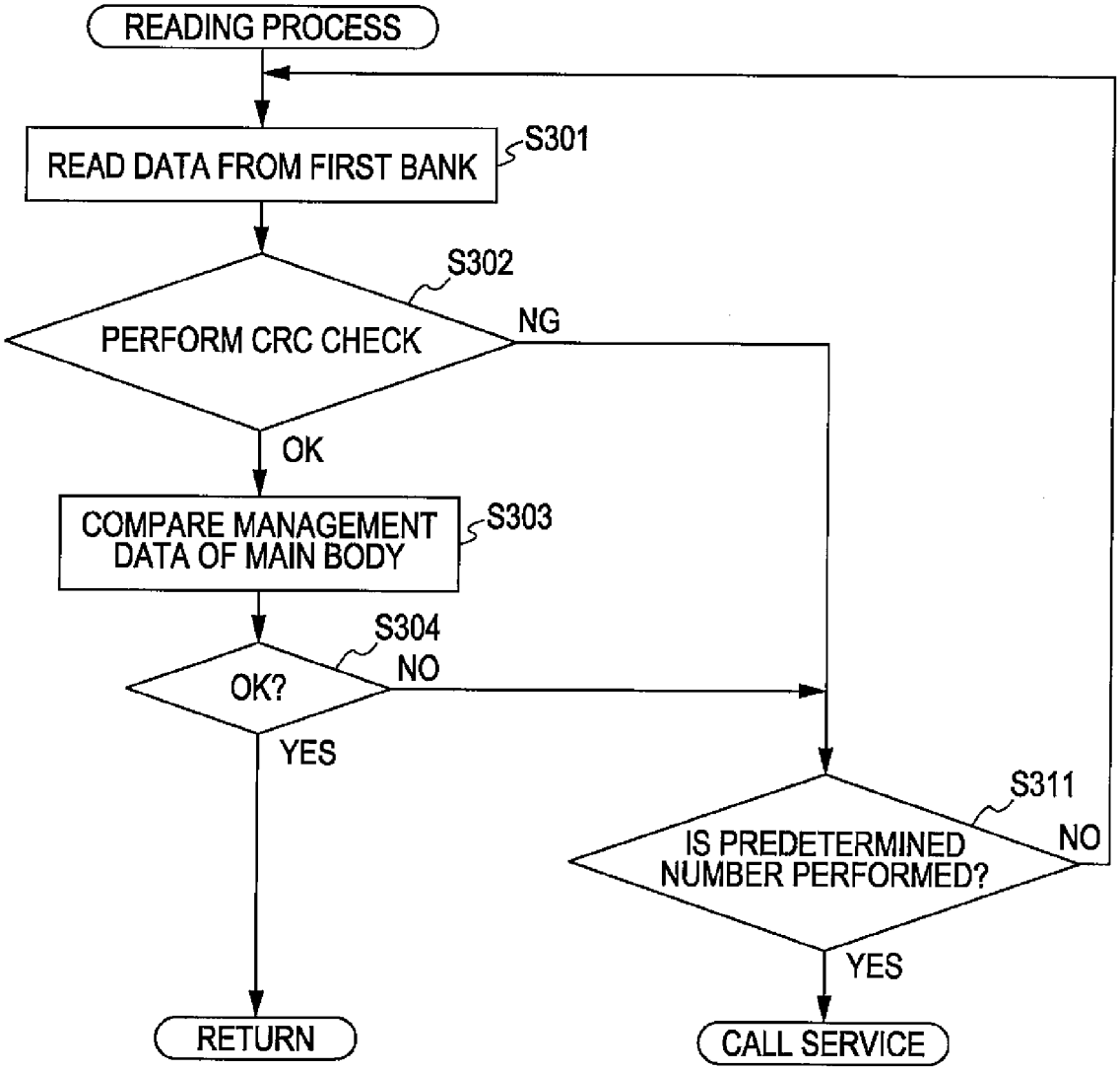
FIG. 7 is a flowchart illustrating a reading process to a first bank.

FIG. 7 is a flowchart illustrating the reading process to a first bank. In the process, first, electromagnetic waves for wireless communication are output from an antenna 109 of the apparatus main body to start access to the memory chip of each of development portions and the data stored in the first bank of the respective memory chips is read (Step S301). A cyclic code for error detection is given to the data. A cyclic redundancy check (CRC) is performed on the basis of the cyclic code (Step S302). When the check result is OK, that is, there is no error in the read data, the read data is compared to that stored separately in an RAM 107 of the apparatus main body to examine whether both data are identical (Step S303). When there is no abnormality in the image forming apparatus and the previous memory access is appropriately performed, both data are identical. When both data are identical, the reading process to the corresponding bank is considered to be appropriately performed, and then the process ends.

The data read from the respective memory chips and the data of the apparatus main body may accord with each other due to the reasons as follows: the previous access process is not appropriately performed, the development unit 4 does not rotate, or the development portion are switched in an inappropriate manner after the previous access process. In the above-described case and in the case where the CRC result is NG in Step S302, the reading process to the corresponding bank is performed again. In addition, even though the reading process is performed a predetermined number of times, but the CRC result is not OK, it is not desirable to continue the process. Accordingly, the process is stayed, and a message for prompting a check of a service man is displayed on a display unit 12 (Step S311). In addition, hereinafter, displaying such a message on the display unit 12 refers to "a service call". "The reading process" is described above.

The reading process and the reading and writing processes according to the second to fourth embodiments described below can be performed in the same manner as the reading process shown in FIG. 7 and the reading and writing processes shown in FIG. 8.

In FIG. 6, the memory access process will keep being described. The reading and writing processes (hereinafter, referred to as the "R/W" processes") to an N-th bank continue to be performed. In the first embodiment, as not shown, when a power of the image forming apparatus is applied and when the development portions are switched, a value 2 is set to a parameter "IN" representing a bank number to be accessed as a default value. The parameter N is separately provided to all of a plurality of the development portions. Accordingly, immediately after the power is applied or immediately when the development portions are switched, the value of the parameter N becomes 2.

Figure 8:
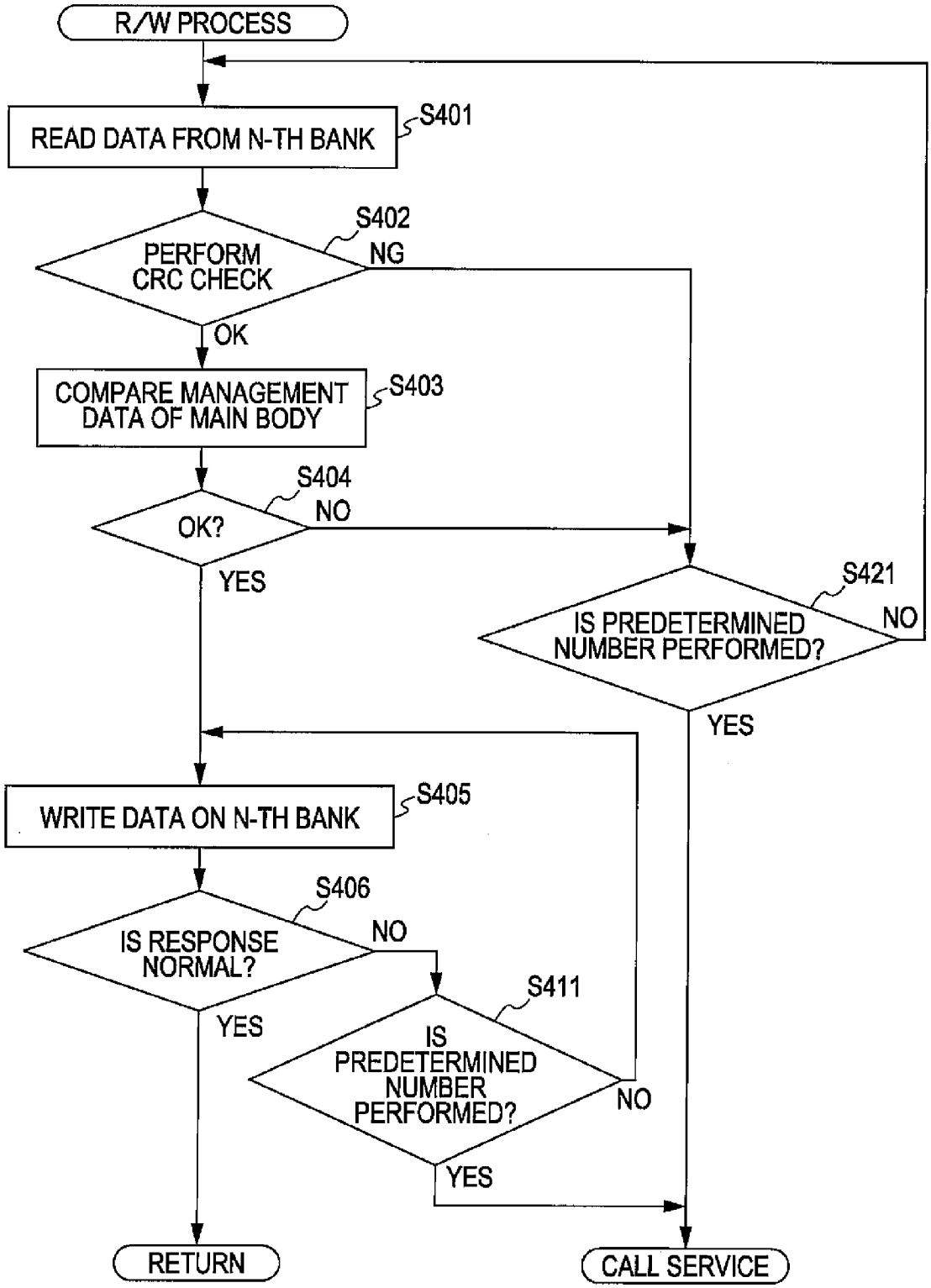
FIG. 8 is a flowchart illustrating R/W processes to an N-th bank.

FIG. 8 is a flowchart illustrating the R/W processes to the N-th bank. First, the stored data is read from the N-th bank by accessing the memory chip (Step S401), the CRC is performed (Step S402), and then the data is compared to that of the apparatus main body (Step S403 and Step S404). If necessary, the reading process is performed again (Step S421). The processes are performed in the same manner as the reading process to the first bank, but the present reading process is performed to the N-th bank. The value of the parameter N is not a fixed value, but the value varies sequentially as described below.

Subsequently, the data is updated by writing new data to the N-th bank (Step S405). That is, the data stored in the N-th bank is overwritten by the new data. At this time, when a response received from the memory chips is not appropriate (Step S406), the writing process is performed again a predetermined number of times like the above-described reading process (Step S411). Even though the writing process is performed the predetermined number of times, the service call is performed. The "R/W processes" is described above.

In FIG. 6, the memory access process will be described. When the reading process to the first bank (Step S201) and the R/W processes to the N-th bank (Step S202) end in the above-described manner, the value of the then parameter N is checked (Step S203). In addition, when the value of the parameter N is not 4, the value increases by 1 (Step S204). Alternatively, when the value of the parameter N is 4, the value is changed into 2 (Step S205). The memory access process according to the first embodiment is described above.

As described above, since the value of the parameter N becomes 2 immediately after the application of the power or immediately after the switching of the development portions, the reading process to the first bank and the R/W processes are performed in the then memory access process. At the time of finishing the memory access process, the value of the parameter N increases to 3. Accordingly, in the memory access process performed when the same development portion is moved to the access position again, the value of the parameter N is 3, and thus the R/W processes is performed to the third bank. In conclusion, in the then memory access process, the reading process to the first bank and the R/W processes to the third bank are performed. Similarly, in the next memory access process, the R/W processes are performed to the fourth bank. In the memory access process, since the value of the parameter N is 4 at the starting time, the value can be changed into 2 at the finishing time. Accordingly, in the next memory access process, the R/W processes are performed again for the second bank. In this way, the R/W processes are performed sequentially and circularly in an order of the bank with the higher priority, the second bank, the third bank, the fourth bank, the second bank, . . . , by the priority.

In this way, according to the first embodiment, the reading process to the first bank and the R/W processes to another bank are performed by performing the memory access process once. The bank to which the R/W processes are performed is changed every access time in accordance with the priority. By performing the R/w processes to some banks when accessed once, it is possible to considerably shorten the time required to perform the memory access process more than a case where the writing process is performed to all the banks when accessed once. In the first embodiment, accordingly, even though the respective development portions stay for a short time, it is possible to update the data more reliably.

A target of the R/W processes is sequentially selected from the bank with the higher priority. Moreover, since the value of the parameter N is initialized at the time of applying the power or switching the respective development portions, the writing process to the bank with the higher priority is performed more frequently. In this way, the more significant the information is in the management of the development portions, the more frequently the information is updated. Accordingly, it is possible to manage the lifetime management of the development portions more appropriately and more efficiently.

Second Embodiment

Figure 9:
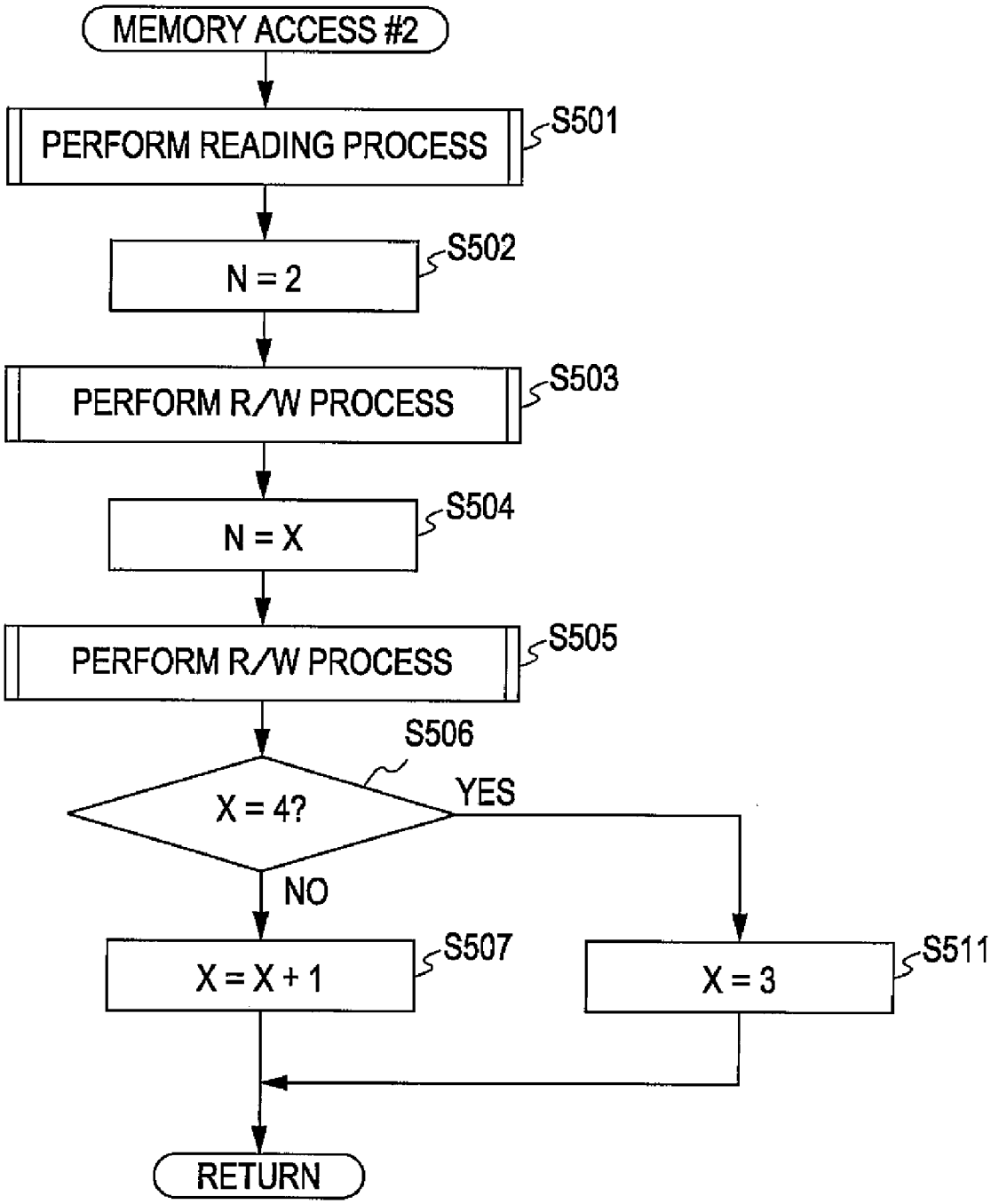
FIG. 9 is a flowchart illustrating the memory access process according to a second embodiment.

FIG. 9 is a flowchart illustrating a memory access process according to a second embodiment. In the second embodiment, a reading process to a first bank used to identify development portions and R/W processes to a second bank used to manage a lifetime of the development portions are performed every access. In addition, the R/W processes are performed to another bank in the same access, but a target of the R/W processes is changed every access. In the second embodiment, another parameter X is also used, and a value of the parameter X is set to 3 as a default value when the power of the image forming apparatus is applied and when the development portions are switched. The parameter X is separately provided to a plurality of the development portions.

First, the reading process to the first bank is performed as the same manner as that according to the first embodiment (Step S501). Subsequently, the value of the parameter N is set to 2, and then the R/W processes are performed (Steps S502 and S503). That is, the R/W processes to the second bank are performed. Contents of the R/W processes are the same as those according to the first embodiment. Next, the value of the parameter N is set to a value of another parameter X (Step S504). At this time, the initial value 3 of the parameter X becomes the value of the parameter N. Subsequently, the R/W processes to the third bank are performed again (Step S505).

Subsequently, when the value of the parameter X is not 4 (that is, X=3), the value increases by 1 (Steps S506 and S507). Alternatively, when the value of the parameter X is 4, the value is changed to 3 (Step S511). In this way, the value of the parameter X is changed to 3 or 4 alternatively when the access to the corresponding development portion is performed.

In the memory access process according to the second embodiment, when the access process is performed initially immediately after application of the power or immediately after switch of the development portions, the reading process to the first bank and the R/W processes to the second and third banks are performed. In the next access, the reading process to the first bank and the R/W processes to the second and fourth banks are performed. Moreover, in the next access, the reading process to the first bank and the R/W processes to the second and third banks are performed like the initial access. That is, in the second embodiment, the reading process to the first bank the R/W processes to the second bank are performed every access. Meanwhile, the R/W processes to the third and fourth banks are performed alternatively in the access thereof.

In the second embodiment, as described above, the information with the higher priority used to identify the development portions and to manage the lifetime of the development portions is read and written every access. However, the information with the relatively lower priority is read and written once in several accesses. In this way, since it is not necessary to write all the information in the access once, the memory access process according to the second embodiment can obtain the same advantage as that according to the first embodiment. In particular, since the information important to the lifetime management is configured to be written every access, it is possible to obtain the higher advantage in the lifetime management of the development portions.

Third Embodiment

Figure 10:
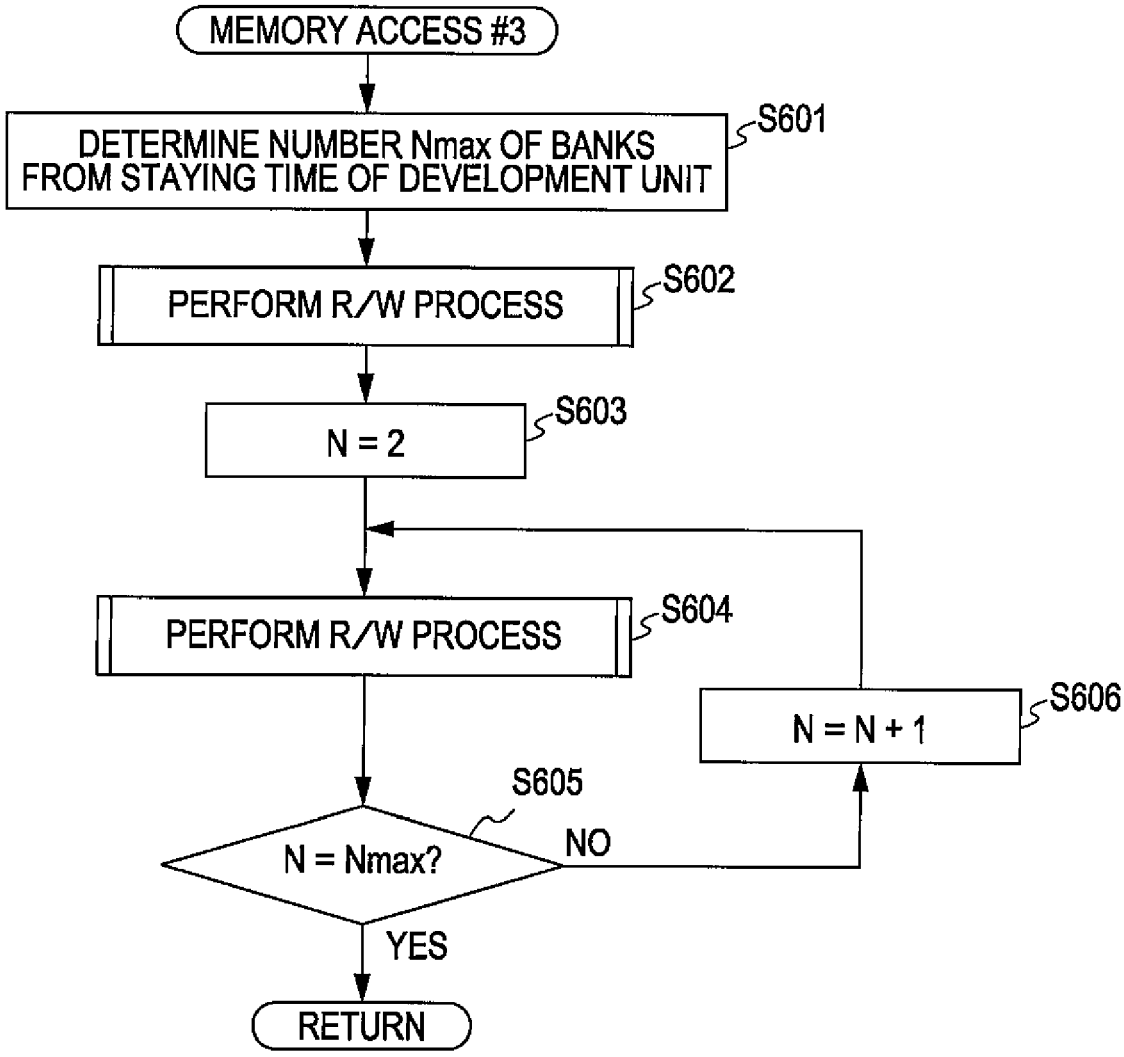
FIG. 10 is a flowchart illustrating the memory access process according to a third embodiment.

FIG. 10 is a flowchart illustrating a memory access process according to a third embodiment. In the third embodiment, it is particularly advantageous when a period of time how long development portions stay at an access position can be estimated. That is, by determining how many banks can be written on the basis of a period of time how long the respective development portions stay, the access to the possible number of the banks is performed.

First, the period of time how long one development portion stays at the access position is calculated from a performing image formation process, and then the maximum number Nmax of the banks accessed during the period of time is determined (Step S601). Naturally, the longer the development portion stays, the more the maximum number Nmax of the banks increases. The staying period of time of the development portion can be predetermined from an operational sequence of performed operational modes (color and black-and-white operations, one-image formation and two-image formation operations). A practical accessible period of time while the development portion stays at the access position is a period when preparation of the data to be written is finished and the development portion starts to move.

When the reading process or the writing process fails, the reading process and the R/W processes to the respective banks are performed again. Accordingly, the time necessary to access one bank is not necessarily uniform. At the time of determining the maximum number of the banks, it is desirable to consider a time margin to deal with the above-described circumstance.

In this way, when the maximum number Nmax of the banks is determined, the reading process to the first bank is performed (Step S602). As the value of the parameter N sequentially increases from 2, the R/W processes to the N-th bank is sequentially performed. Subsequently, the R/W processes are reiterated until the value of the parameter N becomes the maximum number Nmax of the banks (Step S603 to S606).

In the third embodiment, the number of the banks as a target of the reading process or the R/W processes is not fixed, but varies in accordance with the period of time how long the respective development portions stay. However, the access order follows the priority of the banks. In other words, in the third embodiment, the access to the maximum number of the banks permissible during the period of time when the respective development portions stay is performed sequentially from the bank with the higher priority. Since the information with the higher priority is updated more frequently, it is possible to manage the lifetime of the development portions more appropriately and more efficiently.

The number of banks as the target of the access varies in accordance with the period of time how long the respective development portions stay. Accordingly, by decreasing the number of the banks to be accessed at the time of quickly finishing the development process, the time necessary to access the banks can be shortened. Then, when finishing the development process, the respective development portions can be switched quickly. In contrast, if the respective development portions stay for a long time, it is possible to complete the writing process to all the banks by accessing the banks once.

Fourth Embodiment

Figure 11:
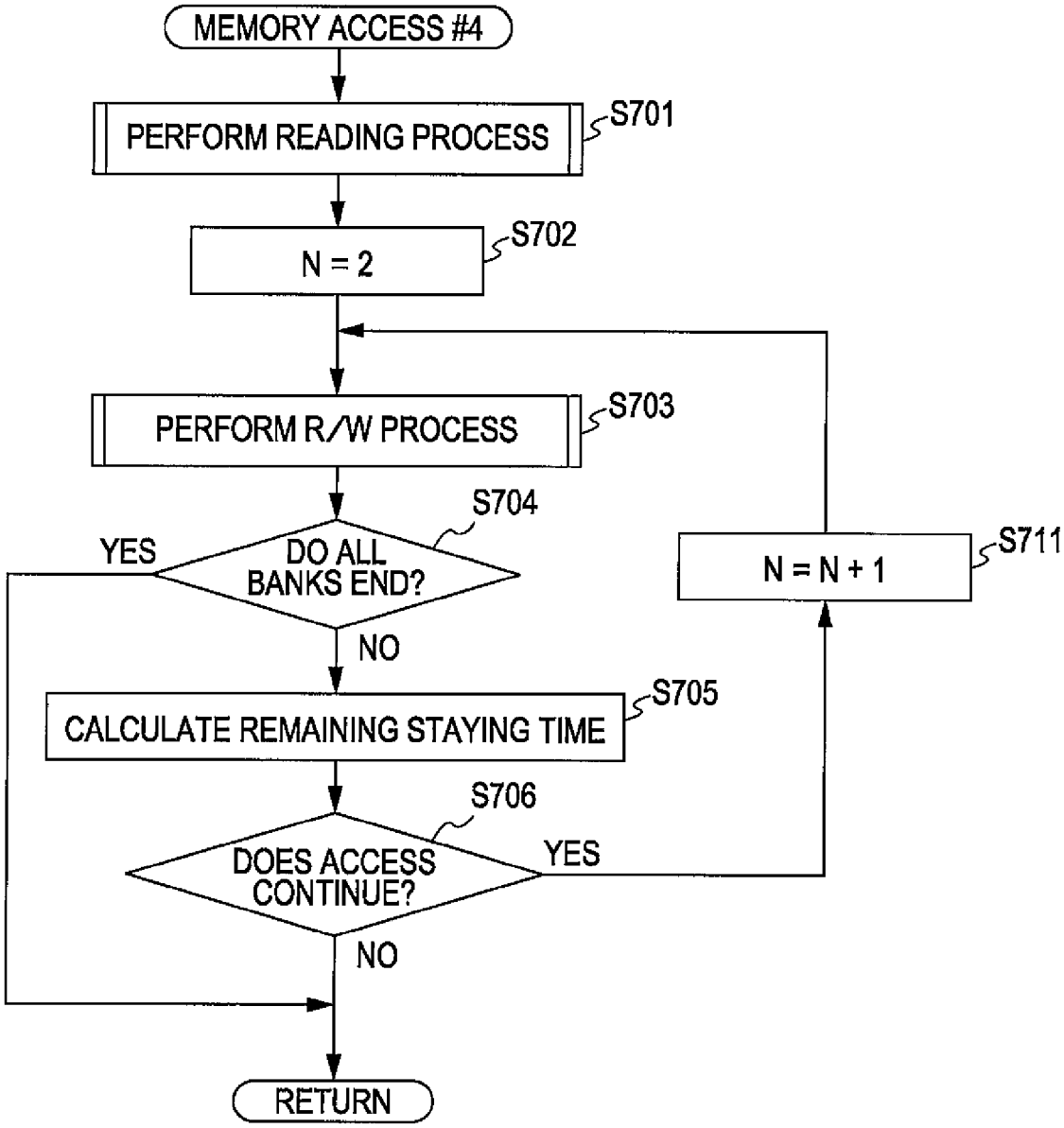
FIG. 11 is a flowchart illustrating the memory access process according to a fourth embodiment.

FIG. 11 is a flowchart illustrating a memory access process according to a fourth embodiment. In the fourth embodiment, the number of the banks to be accessed varies on the basis of how long the respective development portions stay like the third embodiment. However, the number of the banks is not predetermined, but whenever the R/W processes to one bank are finished, it is determined whether there is affordable time to perform the R/W processes to the next bank.

First, like the above-described embodiments, the reading process to the first bank is performed (Step S701). Next, the value of the parameter N is set to 2, and then the R/W processes are performed (Steps S702 and S703). When finishing the access to all the banks, the memory access process ends (Step S704). Alternatively, when the bank as a target of the R/W processes remains, the remained period of time (remaining staying period of time) how long the respective development portions stay is calculated from the then time (Step S705). Subsequently, it is determined whether the access to the next bank continues from the calculated remaining period of time (Step S706). Specifically, when sufficient period of time to access the next bank is sufficient from the remaining period of time, it is determined that the access continues. Alternatively, when the remaining period of time is not sufficient, and thus the affordable time to access the next bank is not sufficient, the access ends. When the access continues, the value of the parameter N increases (Step S711) and the above-described processes are reiterated.

In the fourth embodiment, whenever the access to one bank is performed, whether the access to the next bank is performed is determined on the basis of the remaining staying period of time of the respective development portions. In this way, it is possible to perform the writing process to the banks as many as possible while the respective development portions stay. Since the number of the banks varies in accordance with the staying period of time of the respective development portions, it is possible to quickly switch the respective development portions after the completion of the development process by shortening the time required to perform the access like the third embodiment. Moreover, if the respective development portions stay for a long time, it is possible to complete the writing process to all the banks by accessing the banks once.

Other Embodiments

As described above, the respective development portions 4Y, 4M, 4C, and 4K serve as "development portions" according to the invention. The development unit 4 holding and rotating the development portions serves as "a development unit holder" according to the invention. In the embodiments, the engine controller 10 including the CPU 101 serves as "a controller" according to the invention. The transceiver 105 and the antenna 109 serve together as "an access unit" according to the invention. The memory chips 491Y, 491M, 491C, and 491K of the development portions serve as "a memory" according to the invention.

The invention is not limited to the above-described embodiments, but may be modified to various forms without departing from the gist of the invention. For example, in the image forming apparatus, the information stored in the memory chip of the respective development portions is shown in FIG. 5, but the information is just one example of the information. Accordingly, the information to be stored in the memory chip is not limited thereto.

In the above-described embodiments, the number Ng of groups is exemplified as 3, but the number of groups is not limited thereto. That is, the first embodiment is applicable when the number Ng of groups is a natural number of 2 or more. For example, when the number Ng of groups is 2, the fourth bank is not necessary in the first embodiment. In this case, the bank as the target of the R/W processes is alternatively switched to the second bank or the third bank in the access. In addition, the frequency of the access to the second bank is more than that of the access to the third bank. That is, the number of the access to the second bank may not be smaller than that of the access to the third bank. When the number Ng of groups is 4, in the first embodiment, there is provided a fifth bank of which the priority is lower than that of the fourth bank. In this case, the bank as the target of the R/W processes is sequentially changed from the second bank, the third bank, the fourth bank, the fifth bank, the second bank, . . . , by the priority.

The second embodiment is different from the first embodiment in that the R/W processes to one group with the highest priority are performed every access. However, the processes to the subsequent groups are the same as those according to the first embodiment. Accordingly, the second embodiment is applicable when the number Ng of groups is a natural number of 3 or more. Moreover, the number of groups to be accessed varies in accordance with the staying time of the respective development portions in the third and fourth embodiments. Accordingly, the third and fourth embodiments are applicable when the number of groups is 2 or more.

In the second embodiment, there may be provided the fifth subsequent bank. In this case, the reading process to the first bank is performed every access, and the R/W processes to the second bank are performed in the access like the second embodiment. The banks as the target of the R/W processes every access are the third subsequent banks. Accordingly, when the fifth bank is provided, there become 3 or more banks as the target. Since the banks to be switched are 2 (the third and fourth banks) in the second embodiment, only one bank is selectively the target of the R/W processes. However, when the banks to be switched are 3 or more, the plurality of banks may be the target of R/W processes in the access once. For example, when five banks are provided in the second embodiment, two banks are switched in the access. That is, the third and fourth banks can be the target of the R/W processes in the initial access and the fifth and third banks can be the target of the R/W processes in the next access. With such an above-described configuration, it is possible to shorten the time required to access the banks more than the case where all the data are written in the access once.

In the above-described embodiments, the wireless communication is carried out through the wireless communication antennas disposed in the apparatus main body and the development portions, but the invention is not limited thereto. For example, even when connectors are mechanically connected to each other via communication lines to carry out the communication, the invention is appropriately applicable.

In the above-described embodiments, when the calculation of the toner residual quantity to be written to the respective memories is finished, the memory access process is started. That is because the time for calculating the toner residual quantity is later than time when the respective development portions stay. However, in a case where the calculation is finished at the time the respective development portions stay, it is possible to perform the memory access process immediately after the respective development portions stay.

In the above-described embodiments, the reading process and the R/W processes to the second to fourth banks of the respective memory chips are all performed. However, the invention is applicable to an apparatus performing only the writing process.

Moreover, in the above-described embodiments, there is provided the image forming apparatus capable of forming the color image on the intermediate transfer belt using the four-color toner. However, the invention is not limited to the number or types of the toner. Instead of the intermediate transfer belt, another intermediate transfer member such as an intermediate transfer drum may be provided. In addition, the invention is applicable to an apparatus configured to overlap a toner image on a photosensitive member or a print material without providing the intermediate transfer member.

What is claimed is:

1. An image forming apparatus comprising:

a development portion holder that is mounted with a plurality of development portions having a memory storing plural types of information on the corresponding development portion and that selectively portions one of the development portions in a predetermined development positions by holding and moving the mounted development portions;

a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority, and the access unit records only some information of the plural types of information in the memory and most frequently records the information with the highest priority in the memory, while the development portions stays at the access position.

2. The image forming apparatus according to claim 1, wherein the plural types of information are grouped into Ng groups from a first group with the highest priority to an Ng-th group (where Ng is a natural number of 2 or more) with the lowest priority by the priority, and wherein the access unit records the information belonging to a single group in the memory while the respective development portions stay at the access position and the group to be recorded is sequentially and circularly changed from the first group whenever the corresponding development portion is positioned at the access position.

3. The image forming apparatus according to claim 1, wherein the plural types of information are grouped into Ng groups from a first group with the highest priority to an Ng-th group (where Ng is a natural number of 3 or more) with the lowest priority by the priority, and wherein the access unit records the information belonging to two or (Ng−1) groups including the first group in the memory while the respective development portions are positioned at the access position and the group to be recorded other than the first group is sequentially and circularly changed from the second group whenever the respective development portions are positioned at the access position.

4. The image forming apparatus according to claim 1, wherein the plural types of information include lifetime information used for the controller to manage a lifetime of the development portions and the highest priority is given to the lifetime information.

5. The image forming apparatus according to claim 4, wherein the lifetime information varies with the use of the respective development portions.

6. An image forming apparatus comprising:

a development portion holder that is mounted with a plurality of development portions having a memory storing plural types of information on the corresponding development portion and that selectively portions one of the development portions in a predetermined development positions by holding and moving the mounted development portions;

a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority and the plural types of information are grouped into Ng groups from a first group with the highest priority to an Ng-th group (where Ng is a natural number of 2 or more) with the lowest priority by the priority, wherein in the image forming process, the controller determines the number of groups which can be written by the access unit on the basis of how long the respective development portions stays at the access position, and wherein the access unit records the information belonging to the groups of the number determined by the controller in the memory sequentially from the first group by priority.

7. The image forming apparatus according to claim 6, wherein the controller can perform a plurality of image forming modes in which the periods of time for allowing the development portion holder to position the respective development portions at the access position are different.

8. An image forming apparatus comprising:

a development portion holder that is mounted with a plurality of development portions having a memory storing plural types of information on the corresponding development portion and that selectively portions one of the development portions in a predetermined development positions by holding and moving the mounted development portions;

a controller that controls the development portion holder to switch the development portions to be positioned at the predetermined development position and that performs an image forming process using the development portions positioned at the development position; and an access unit that accesses the memory of the development portion positioned at an access position, which is a position at which one of the other development portions mounted in the development portion holder is placed so as write the information therein, when one of the development portions mounted in the development portion holder is positioned at the development position, wherein the plural types of information are predetermined in priority and the plural types of information are grouped into Ng groups from a first group with the highest priority to an Ng-th group (where Ng is a natural number of 2 or more) with the lowest priority by the priority, wherein the access unit records the information belonging to the group sequentially from the first group by the priority on the basis of the control instruction of the controller, and wherein the controller determines whether to allow the access unit to record the information belonging to the next group on the basis of the time until the respective development portions starts movement from the access position, and gives a control instruction to the access unit on the basis of the determination result.

9. An image forming method of selectively positioning a plurality of development portions in a predetermined corresponding development position, forming an image using the development portions positioned at the development position, and accessing a memory of the respective development portions positioned at an access position different from the development position to perform an image forming process of writing plural types of information on the development portion, the image forming method comprising:

predetermining the plural types of information in priority;

writing only some information among the plural types of information in the memory while the respective development portions stay at the access position; and writing the information with the highest priority in the memory most frequently.

10. An image forming method of selectively positioning a plurality of development portions in a corresponding predetermined development position, forming an image using the respective development portions positioned at the development position, and accessing a memory of the respective development portions positioned at an access position different from the development position to perform an image forming process of writing plural types of information on the development portion, the image forming method comprising:

predetermining the plural types of information in priority so as to group the plural types of information into Ng groups sequentially from a first group with the highest priority to an Ng-th group (where Ng is a natural number of 2 or more) with the lowest priority by the priority;

determining the number of storable groups of the Ng groups on the basis of how long the respective development portions stays at the access position; and writing the information belonging to the groups of the determined number of the groups from the first group by the priority.

11. An image forming method of selectively positioning a plurality of development portions in a predetermined corresponding development position, forming an image using the respective development portions positioned at the development position, and accessing a memory of the respective development portions positioned at an access position different from the development position to perform an image forming process of writing plural types of information on the development portion, the image forming method comprising:

predetermining the plural types of information in priority so as to group the plural types of information into Ng groups sequentially from a first group with the highest priority to an Ng-th (where Ng is a natural number of 2 or more) group with the lowest priority by the priority;

writing the information belonging to the group sequentially from the first group by the priority; and determining whether to allow the access unit to record the information belonging to the next group on the basis of the time until the development portions starts movement from the access position whenever writing the information belonging to one group.

* * * * *